US007570257B2

(12) United States Patent
Ikeda

(10) Patent No.: US 7,570,257 B2
(45) Date of Patent: Aug. 4, 2009

(54) DISPLAY DEVICE AND METHOD FOR DRIVING DISPLAY DEVICE

(75) Inventor: Kyoji Ikeda, Gifu Prefecture (JP)

(73) Assignee: Sanyo Electric Co., Ltd. (JP)

( * ) Notice: Subject to any disclaimer, the term of this patent is extended or adjusted under 35 U.S.C. 154(b) by 663 days.

(21) Appl. No.: 11/395,904

(22) Filed: Mar. 31, 2006

(65) Prior Publication Data

US 2006/0221012 A1 Oct. 5, 2006

(30) Foreign Application Priority Data

Mar. 31, 2005 (JP) ..... 2005-103181

(51) Int. Cl.
*G09G 3/30* (2006.01)

(52) U.S. Cl. ..... 345/204; 345/51; 345/52; 345/63; 345/77; 345/205; 345/211; 345/214; 345/690; 315/169.3

(58) Field of Classification Search ..... 345/48, 345/51, 52, 63, 77, 204, 205, 211, 214, 690
See application file for complete search history.

(56) References Cited

U.S. PATENT DOCUMENTS

| | | | | |
|---|---|---|---|---|
| 6,194,837 | B1 | 2/2001 | Ozawa | |
| 6,545,424 | B2 | 4/2003 | Ozawa | |
| 2002/0118312 | A1 * | 8/2002 | Ishizuka et al. | 348/797 |
| 2004/0113872 | A1 | 6/2004 | Nanno et al. | |
| 2004/0119704 | A1 | 6/2004 | Miyajima et al. | |
| 2005/0062868 | A1 * | 3/2005 | Shiiba et al. | 348/316 |

FOREIGN PATENT DOCUMENTS

| | | |
|---|---|---|
| JP | 2003-29708 | 1/2003 |

OTHER PUBLICATIONS

Japanese Patent Laid-Open Publication No. Hei 11-24604, and its English abstract.
Japanese Patent Laid-Open Publication No. 2003-150127, and ts English abstract.
Chinese Office Action for Chinese Patent Application No. 200610067035.2 mailed May 9, 2008 with English Translation.

* cited by examiner

*Primary Examiner*—Bipin Shalwala
*Assistant Examiner*—Vince E Kovalick
(74) *Attorney, Agent, or Firm*—Cantor Colburn, LLP

(57) ABSTRACT

An element driving transistor controls an amount of power supplied from a power supply PVDD to an element to be driven (display element) provided in a pixel of each row. A storage capacitor has a first electrode connected to a gate electrode of an element driving transistor and a second electrode connected to a capacitor line. A voltage level of a capacitor control signal SCn to be output to the capacitor line is set to a voltage level which controls the element driving transistor via the storage capacitor Cs to be periodically switched off. A V driver formed at a periphery of a display portion of a panel has a generator which generates a capacitor control signal SCn using outputs of registers which sequentially transfer and output a signal according to a V start signal STV so that the off-control period of the element driving transistor is determined according to the H level period of the V start signal STV. The voltage level of the capacitor control signal allows, for each row, the element driving transistor to be controlled to be switched off for a period according to the signal STV and persistent images can be improved.

12 Claims, 9 Drawing Sheets

DISPLAY DEVICE AND METHOD FOR DRIVING DISPLAY DEVICE

CROSS-REFERENCE TO RELATED APPLICATIONS

The entire disclosure of Japanese Patent Application No. 2005-103181 including specification, claims, drawings, and abstract is incorporated herein by reference.

BACKGROUND OF THE INVENTION

1. Field of the Invention

The present invention relates to control of a persistent image in a display device which uses, for example, an organic electroluminescence element as a display element in each pixel.

2. Description of the Related Art

Display devices which use an organic electroluminescence (EL) element, which is a current-driven light emitting element, as a display element in each pixel are known and, in particular, active matrix display devices in which a transistor (thin film transistor or "TFT") is provided in each pixel for individually driving, for each pixel, the organic EL element provided in each pixel are currently under development.

In an active matrix display device, a gate line GL is provided along a horizontal scan direction (row direction), a data line DL and a power supply line PL are provided along a vertical scan direction (column direction), and pixels are defined by these lines. As the equivalent circuit of each pixel, a circuit shown in FIG. 1 is known in which each pixel comprises a selection transistor Ts which is an n-channel TFT, a storage capacitor Cs, a p-channel element driving transistor Td, and an organic EL element EL. The selection transistor Ts has a drain connected to a data line DL which supplies a data voltage to pixels positioned along the vertical scan direction, a gate connected to a gate line GL for selecting pixels positioned along the horizontal scan direction, and a source connected to a gate of the element driving transistor Td.

The element driving transistor Td is a p-channel TFT and has a source connected to the power supply line PL and a drain connected to an anode of the organic EL element EL. A cathode of the organic EL element EL is formed common to the pixels and is connected to a cathode power supply CV. One electrode of a storage capacitor Cs is connected between the gate of the element driving transistor Td and the source of the selection transistor Ts. The other electrode of the storage capacitor Cs is connected to a power supply of a constant voltage such as, for example, ground.

In this circuit, when the gate line GL is set to the H level, the selection transistor Ts is switched on, a data voltage on the data line DL is supplied via the selection transistor Ts to the gate of the element driving transistor Td, and a voltage corresponding to the data voltage is stored in the storage capacitor Cs. In this manner, the element driving transistor Td allows a drive current corresponding to the gate voltage (the voltage stored in the storage capacitor Cs) of the element driving transistor Td to flow through the element transistor Td, and even when the gate line GL is set to an L level, the element driving transistor Td supplies the drive current from the power supply line PL connected to a drive power supply PVDD to the organic EL element EL according to the voltage stored in the storage capacitor Cs, and thus as a result the organic EL element EL emits light at an intensity corresponding to the drive current.

Japanese Patent Laid-Open Publication Nos. Hei 11-24604 and 2003-150127 disclose art related to the present invention.

The above-described organic EL element has superior responsiveness with respect to supply and termination of supply of current, and fundamentally, the persistent image does not tend to occur. However, in the display device which uses a pixel circuit as described above, there is a problem in that persistent images occur and display quality is degraded. This is considered to be due to hysteresis of the p-channel element driving transistor. More specifically, the element driving transistor supplies a drive current from the power supply PVDD for approximately one frame period according to the data voltage stored in the storage capacitor and supplied to the gate of the element driving transistor and then, after the next data voltage is written to the storage capacitor Cs, supplies a drive current in the next frame period according to a new data voltage. Because the element driving transistor Td supplies the same current throughout one frame period in this manner, this state is retained and the influence of the data voltage written previously remains even after the next data voltage is supplied. This phenomenon becomes even more significant when the data voltage is at an intermediate level and becomes particularly problematic when an animated image having a large variation in data voltage is to be displayed.

The details of the cause of the occurrence of the persistent image are not fully understood at this point, but some conjecture has been made, such as that the carriers (holes) flowing in the channel of the element driving transistor are trapped in the gate insulating film and the threshold voltage of the element driving transistor is changed by the trapped carriers.

SUMMARY OF THE INVENTION

The present invention advantageously improves the persistent image.

According to one aspect of the present invention, there is provided a display device having a plurality of pixels arranged in a matrix and a vertical driver which sequentially drives the plurality of pixels, wherein each of the plurality of pixels comprises an element to be driven, a selection transistor which reads a data signal from a data line extending along a vertical scan direction according to a selection signal output on a selection line extending along a horizontal scan direction, a storage capacitor having a first electrode and a second electrode and which stores, as a voltage with respect to a voltage supplied from a capacitor line to the second electrode, a data signal from the selection transistor supplied to the first electrode, and an element driving transistor having a gate connected to the first electrode of the storage capacitor and which supplies a power corresponding to a data voltage stored in the storage capacitor from a power supply to the element to be driven, a plurality of the selection lines are provided, each of which extends along the horizontal scan direction, and the vertical driver comprises a vertical transfer register having a plurality of stages of registers which sequentially read and transfer a vertical start signal indicating a start timing of one vertical scan period, a selection signal generator which generates a selection signal to be supplied to the selection line, and a capacitor control signal generator which generates a capacitor control signal to be supplied to the capacitor line. The selection signal generator generates, based on the vertical start signal, the selection signals at timings which differ from each other by one horizontal scan period to be sequentially supplied to the selection lines, the capacitor control signal generator generates the capacitor control signal based on an output, corresponding to the vertical start signal, from the register of each stage of the vertical transfer register, and the capacitor control signal has a first voltage level state which causes the storage capacitor to store the voltage corresponding to the data signal via the capacitor line and causes the element driving transistor to operate according to the stored voltage and a second voltage level state which causes a corresponding element driving transistor to be controlled to be switched off.

According to another aspect of the present invention, it is preferable that, in the display device, the capacitor line is provided for each row and extending along the horizontal scan direction, and the capacitor control signals are sequentially output from the vertical driver to the capacitor lines at timings that differ from each other by one horizontal scan period.

According to another aspect of the present invention, it is preferable that, in the display device, the vertical transfer register of the vertical driver transfers the vertical start signal to the register of a next stage every horizontal period according to a vertical transfer clock signal, and the selection signal generator and the capacitor control signal generator generate the selection signal to be supplied to the corresponding selection line and the capacitor control signal to be supplied to the capacitor line based on a difference in timing of outputs from the stages of the vertical transfer register.

According to another aspect of the present invention, it is preferable that, in the display device, the vertical driver determines a duration of the second voltage level, which controls the element driving transistor to be switched off, of the capacitor control signal based on a duration of a start instruction level of the vertical start signal.

According to another aspect of the present invention, it is preferable that, in the display device, at least the vertical transfer register, the selection signal generator, and the capacitor control signal generator of the vertical driver are formed at a peripheral position of a display portion on a substrate on which the plurality of pixels are formed.

According to another aspect of the present invention, it is preferable that, in the display device, the selection signal generator and the capacitor control signal generator comprise logic calculation units which perform logic calculations using a difference between an output of a register of a corresponding stage of the vertical transfer register and an output from a register of an adjacent stage, and generate the selection signal and the capacitor control signal.

According to another aspect of the present invention, it is preferable that, in the display device, the capacitor control signal generator generates the capacitor control signal by inverting an output from the register of a corresponding stage of the vertical transfer register, and the selection signal generator generates the selection signal based on an output from the register of the corresponding stage of the vertical transfer register and an inverted signal of an output from a register of an adjacent stage.

According to another aspect of the present invention, there is provided a method of driving a display device comprising a plurality of pixels arranged in a matrix of n rows and m columns, wherein a selection line and a capacitor line are formed for each row along a horizontal scan direction, a data line is formed for each column along a vertical scan direction, each of the plurality of pixels comprises an element to be driven, a selection transistor having a gate connected to the selection line and a first conductive region connected to the data line and which reads a data signal from the data line according to a selection signal output on the selection line, an element driving transistor having a gate connected to a second conductive region of the selection transistor and which controls power to be supplied from a power supply to the element to be driven, and a storage capacitor having a first electrode and a second electrode, wherein the first electrode is connected to the second conductive region of the selection transistor and the gate of the element driving transistor, the second electrode is connected to the capacitor line, and a data signal supplied via the selection transistor to the first electrode is stored in the storage capacitor as a potential difference with respect to a capacitor control signal supplied from the capacitor line to the second electrode. A selection signal is output to the selection line of an nth row to control the selection transistors of pixels of the nth row to be switched on and write a voltage corresponding to a data signal to the storage capacitor, and a potential of the capacitor control signal to be output to the capacitor line of the nth row is set to a first voltage level which causes the element driving transistor to be switched on and operate according to a data signal supplied via the selection transistor, and after the first voltage level is maintained for a period corresponding to a duration of a start instruction level of a vertical start signal indicating a start timing of one vertical scan period, the potential of the capacitor control signal is changed to a second voltage level which controls, via the capacitor line, the element driving transistor to be switched off for a period in which the selection line of the nth row is not selected and until the start of the next vertical scan period so that the element driving transistor and the element to be driven are controlled to be switched off.

As described, according to the present invention, a capacitor control signal generator of a vertical scan direction (a column direction of the matrix) driver for generating a selection signal to be output to the pixel of each row outputs, in a periodic manner, a potential, that can forcefully control the element driving transistor of the corresponding pixel to be switched off, onto a capacitor line connected to the storage capacitor of each pixel based on a vertical start signal which indicates a start timing of a vertical scan period. The vertical driver generates the selection signal using the vertical start signal, and therefore, the capacitor control signal can be generated with a simple structure by generating the capacitor control signal similarly using the vertical start signal.

In addition, the vertical driver can output a selection signal which sequentially selects, for each row, pixels arranged in a matrix at timings which are deviated from each other by a horizontal scan period. Therefore, the capacitor control signal generator can generate the capacitor control signal using a structure or a signal which is common with the selection signal generator, and the capacitor line can be controlled for each row. Moreover, by generating the capacitor control signal for each row, the off-control period of the element driving transistor can be controlled for each row, allowing for switching off of the element driving transistor for the same duration at any position of the row in the matrix, and thus, persistent images can be reliably improved.

By generating the capacitor control signal using the outputs of registers of the vertical transfer register which transfer the vertical start signal every horizontal scan period, the duration (pulse width of the vertical start signal) of the start instruction level of the vertical start signal (V start signal) can be adjusted and the off-control period of the element driving transistor of the corresponding row can be adjusted.

By providing a generator which generates the capacitor control signal within the vertical driver, the capacitor control signal generator can be formed with a simple structure and internally on the same substrate as the substrate on which the display portion is formed along with the control signal generator and the vertical transfer register. Therefore, it is possible to control the capacitor line for each row to switch the element driving transistor off to resolve persistent images without increasing a connection terminal of the display device with an external driver IC or the like.

BRIEF DESCRIPTION OF THE DRAWINGS

Preferred embodiments of the present invention will be described in detail by reference to the drawings, wherein.

DESCRIPTION OF THE PREFERRED EMBODIMENTS

Figure 1:
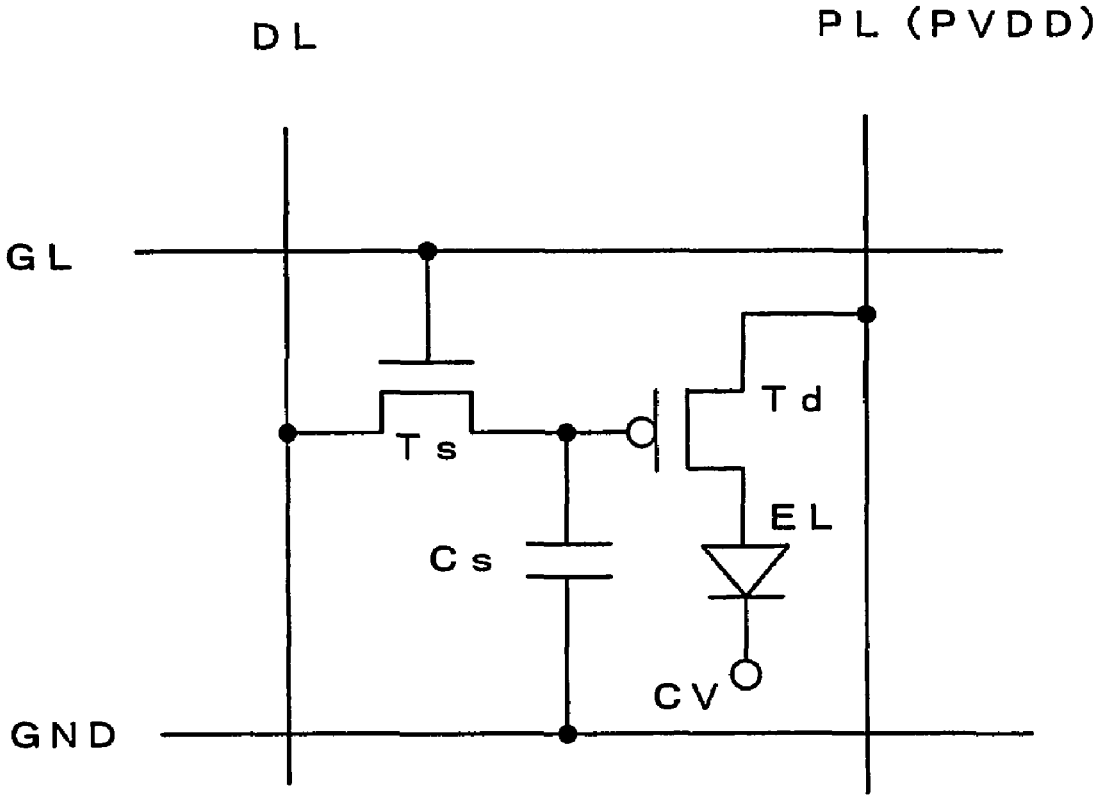
Fig. 1 PRIOR ART
FIG. 1 is a diagram showing an equivalent circuit of a pixel of a light emitting display device of related art.

Preferred embodiments of the present invention will now be described referring to the drawings.

First Preferred Embodiment

Figure 2:
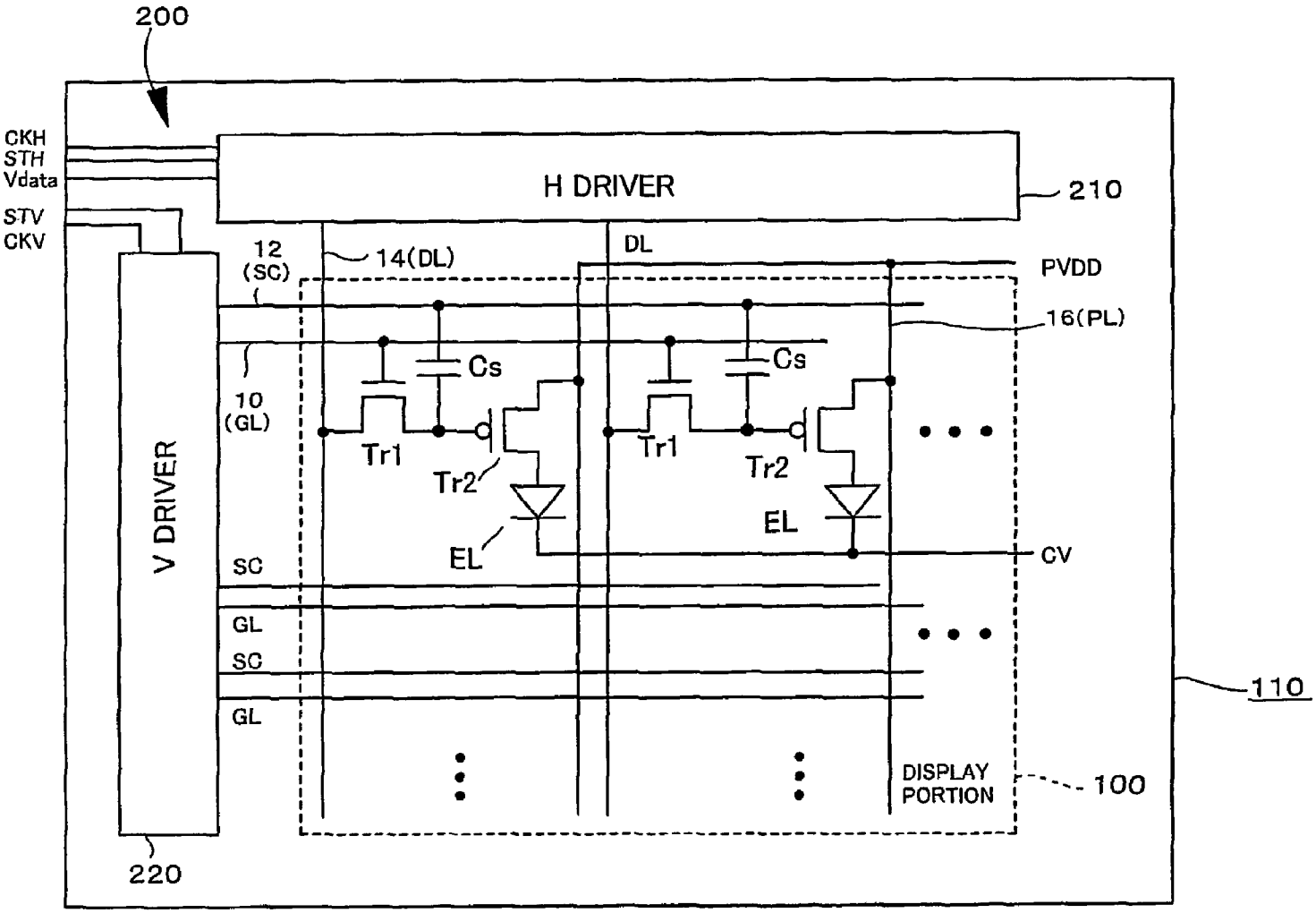
FIG. 2 is an explanatory diagram schematically showing an equivalent circuit of a light emitting display device according to a preferred embodiment of the present invention.

In this embodiment, the display is an active matrix organic EL display wherein a plurality of pixels are placed on a panel substrate 110 such as glass in a matrix form. FIG. 2 is a diagram showing an equivalent circuit structure of the active matrix display according to the present embodiment. A gate line (selection line) 10 (GL) to which a selection signal is sequentially output is provided along a horizontal scan direction (row direction) of the panel substrate 110 and a data line 14 (DL) to which a data signal is output and a power supply line (PL) 16 for supplying an operation power supply (PVDD) to an organic EL element which is an element to be driven are provided along a vertical scan direction (column direction).

Each pixel is provided around a region defined by these lines and comprises, as circuit elements, an organic EL element which is the element to be driven, a selection transistor Tr1 which is an n-channel TFT, a storage capacitor Cs, and an element driving transistor Tr2 which is a p-channel TFT.

The selection transistor Tr1 has a drain connected to a data line 14 for supplying a data voltage to the pixels positioned along the vertical scan direction, a gate connected to a gate line 10 for selecting pixels on one horizontal scan line, and a source connected to a gate of the element driving transistor Tr2.

The element driving transistor Tr2 has a source connected to a power supply line 16 and a drain connected to an anode of the organic EL element EL. A cathode of the organic EL element EL is formed common to the pixels and is connected to a cathode power supply CV.

A first electrode of a storage capacitor Cs is connected to the gate of the element driving transistor Tr2 and to the source of the selection transistor Tr1, and a second electrode of the storage capacitor Cs is connected to a capacitor line 12 (SC). The capacitor line 12 is formed extending parallel to the selection line 10 and along the row direction and a capacitor control signal having a voltage which periodically changes is supplied to the capacitor line 12 in order to improve persistent images in the pixels, as will be described.

In both the selection transistor Tr1 and the element driving transistor Tr2, crystalline silicon such as, for example, polycrystalline silicon obtained by polycrystallization through laser annealing is used in the active layer. In addition, the selection transistor Tr1 and the element driving transistor Tr2 may be an n-channel thin film transistor (TFT) or a p-channel thin film transistor in which an n-conductive impurity or a p-conductive impurity is doped, respectively.

When the TFT in which crystalline silicon is used in the active layer as described above is employed as the transistor of the pixel circuit, the crystalline silicon TFT can be used not only for the pixel circuit, but also as circuit elements of a peripheral driver circuit for sequentially selecting and controlling the pixels. Therefore, in the present embodiment, a crystalline silicon TFT similar to that in the pixel circuit is formed outside a display portion 100 on the panel substrate 110 on which the display portion 100 is formed, simultaneously with the formation of the transistors for the pixel circuit, so that a peripheral driver circuit 200 is built in. In the display portion 100, a plurality of pixels each having the structure as described above are placed in a matrix form.

The driver 200 outputs various control signals for driving the pixels in the display portion 100. More specifically, the driver 200 comprises an H driver (horizontal direction driver circuit) 210 and a V driver (vertical driver circuit) 220. The H driver 210 outputs corresponding data signals to a plurality of data lines 14 extending along the column direction of the matrix. The V driver 220 comprises a selection signal generator (selection outputting section) which generates a selection signal for causing the selection transistor Tr1 to be switched on every horizontal scan (1H) period and sequentially outputs the selection signal to a plurality of selection lines 10 extending along the row direction of the matrix and a capacitor control signal generator (capacitor control out putting section) which generates and outputs a storage capacitor control signal which causes the potential of the capacitor line 12 to be periodically changed.

Next, a driving method in the structure of FIG. 2 will be described in detail. In each pixel circuit, when the selection signal output to the selection line 10 is set to an H level, the selection transistor Tr1 is switched on and a data voltage corresponding to a data signal on the data line 14 is applied to the gate of the element driving transistor Tr2 and the first electrode of the storage capacitor Cs via the drain and the source of the selection transistor Tr1.

The storage capacitor Cs stores a voltage corresponding to a potential difference between the data voltage applied to the first electrode and a capacitor control voltage supplied from the capacitor line 12 connected to the second electrode. In the present embodiment, during the writing process of the data voltage, the voltage of the capacitor control signal on the capacitor line 12 is maintained at a first voltage level Vsc1 which is a low constant voltage such as, for example, ground level (0V), and the data voltage applied to the first electrode of the storage capacitor Cs is stored as the gate voltage of the element driving transistor Tr2. More specifically, the data voltage is stored in the storage capacitor Cs as a potential difference with respect to the first voltage level applied to the capacitor line 12. Because the element driving transistor Tr2 is a p-channel transistor, the data voltage determines the drive current to flow through the element driving transistor Tr2 by how low the data voltage is with respect to the power supply voltage PVDD. When the data voltage is lower than the power supply voltage by a larger voltage, the drive current becomes larger, and thus the light emission brightness of the organic EL element is brighter.

Even when the selection signal on the selection line 10 is set to an L level and the selection transistor Tr1 is switched off, the storage capacitor Cs continues to store the voltage corresponding to the data signal. Therefore, the element driving transistor Tr2 continues to supply the drive current to the organic EL element EL and the organic EL element EL emits light according to the data voltage. In the present embodiment, the organic EL element does not continue to emit light according to a previous data signal until a corresponding pixel is selected at the next vertical scan (one frame) period and a new data signal is written, and the element driving transistor Tr2 is controlled to be switched off and the organic EL element is extinguished (switched off) during a period until the next frame period after the organic EL element is allowed to emit light according to the data voltage for a predetermined period.

More specifically, the capacitor control signal to be output to the capacitor line 12 is increased from the first voltage level Vsc1 to a second voltage level Vsc2 which is sufficiently high for switching the element driving transistor Tr2 off (for example, 10V) after a predetermined period has elapsed. As described above, the first electrode of the storage capacitor Cs is connected to the gate of the element driving transistor Tr2 and the source of the selection transistor Tr1. When the potential of the second electrode of the storage capacitor Cs is increased to the second voltage Vsc2 by the capacitor control line SC, the potential of the first electrode of the storage capacitor is increased according to the amount of increase ΔV (Vsc2−Vsc1). The power supply voltage PVDD is set at, for example, 8V. Therefore, when the capacitor control signal is increased to the second potential level Vsc2, the gate voltage Vg of the element driving transistor Tr2 becomes higher than the power supply voltage PVDD which is the source potential (even when the gate voltage Vg is lower than the source potential, the potential difference would be smaller than the operation threshold value Vthp of the transistor Tr2) and the element driving transistor Tr2 is switched off.

Because of this configuration, if one of the pixels is considered, the element driving transistor Tr2 is controlled to be switched off before the pixel of interest is again selected at the next frame period and the organic EL element emits light according to a new data voltage, and thus the organic EL element is forcefully extinguished. In this manner, the element driving transistor Tr2 is controlled to be temporarily switched off and the organic EL element is extinguished, and thus as a result the persistent images can be improved. In addition, in the present embodiment, even when carriers (holes) are trapped in the gate insulating film of the element driving transistor Tr2, because the gate voltage Vg of the element driving transistor Tr2 is increased according to the amount of increase ΔV of the first electrode of the storage capacitor Cs before the display of the next frame period is started, the trapped carriers can be extracted as a tunneling current to the source which is at a lower potential than the gate. Therefore, the electrical characteristic of the element driving transistor Tr2 is initialized and the supply of drive current to the organic EL element can be reliably and completely stopped.

As a method for supplying a capacitor control signal having the first voltage level Vsc1 and the second voltage level Vsc2 to the capacitor line 12 as described above, provision of a capacitor control voltage switching circuit in an external driver IC with respect to a panel substrate 110 on which a display portion 100 and a peripheral driver circuit (driver) 200 are formed as shown in FIG. 2 can be considered. In this method, the capacitor control voltage switching circuit switches the capacitor control signal to a high voltage level so that all potentials on the capacitor line 12 of each row becomes a potential approximately equal to the power supply voltage PVDD during, for example, a vertical return period and supplies the capacitor control signal to the capacitor line 12. In this manner, by providing a capacitor control voltage switching circuit in an external circuit, it is possible to improve the persistent image without changing the circuits built in the panel (the V driver 220 or the like in the present embodiment).

In the present embodiment, however, the structure for switching the capacitor control voltage is built in on the panel substrate. When the voltage on the capacitor line 12 is controlled using an external IC as described above, because the number of panel connection terminals for receiving signals from the external circuits is limited, it is preferable that all capacitor lines 12 be controlled at once and the potentials of all of the capacitor control signals are increased in the return period at once. However, as will be described below, provision of the structure in the built-in driver has an advantage that the control for each individual row becomes easier, and thus the period of the increased voltage can be arbitrarily set. In addition, by controlling the potential of the capacitor line 12 for each row, it is possible to control the element driving transistor Tr2 to be switched off for the same period with respect to any pixel in any row position on the screen. When potentials of all of the capacitor lines 12 are to be increased at once during a return period by an external IC, regarding a pixel which is selected immediately before the vertical return period, a high-voltage is applied from the capacitor line to the storage capacitor immediately after a data signal is written to the storage capacitor, and thus the leakage current of the selection transistor is increased and the data which should have been displayed may be lost, resulting in a degraded display quality.

In addition, because the voltage of the capacitor line 12 is controlled between the first and second voltage levels by an external IC, the actual voltage reaching the gate of the element driving transistor is reduced due to influences of the line resistance and the parasitic capacitance or the like with respect to the line, and thus a high driving capability is required for the external IC such as an increase in the amplitude of the output voltage of the external IC, or an increase in the power consumption in the external IC. If a circuit which generates a capacitor control signal to be output to the capacitor line 12 as described is provided in a driver built into the panel, because the amplitude of the control signal does not significantly differ from that of the selection signal or the like, the capacitor control signal of a sufficient amplitude can be generated with a simple structure while minimizing the increase in the power consumption of the driver, by the capacitor control signal generator circuit and the selection signal generator circuit sharing the power supply, for example. In addition, because the capacitor control signal generated in a built-in driver is output to the capacitor line, the target potential to be reached of the gate voltage Vg of the element driving transistor when the second voltage level Vsc2 is output is higher than that in the control using an external IC by, for example, approximately 10%-20% or more, and the target reaching time can be easily shortened.

A driver structure and an example operation of a structure in which the control circuit of the capacitor line 12 according to the present embodiment is built in the panel will now be described referring to FIGS. 3-5.

First, a basic structure of the H driver 210 and the V driver 220 shown in FIG. 2 will be described. Here, although not specifically shown in the drawings, the H driver 210 comprises a horizontal transfer register having a plurality of stages of the registers, the number of stages corresponding to the number m of columns of the display portion 100, and a sampling circuit. The horizontal transfer register sequentially transfers the H start signal STH instructing a start of one horizontal scan period to the register of the next stage (adjacent row) according to a horizontal clock CKH of a frequency corresponding to a number of pixels along the horizontal scan direction. The sampling circuit samples the display signal V data of, for example, each of R, G, B, and W (White) according to a selection signal corresponding to the signal STH sequentially output from the registers of the stages of the horizontal transfer register and outputs the sampled signal to the corresponding data line 14 as a data signal DL.

Figure 3:
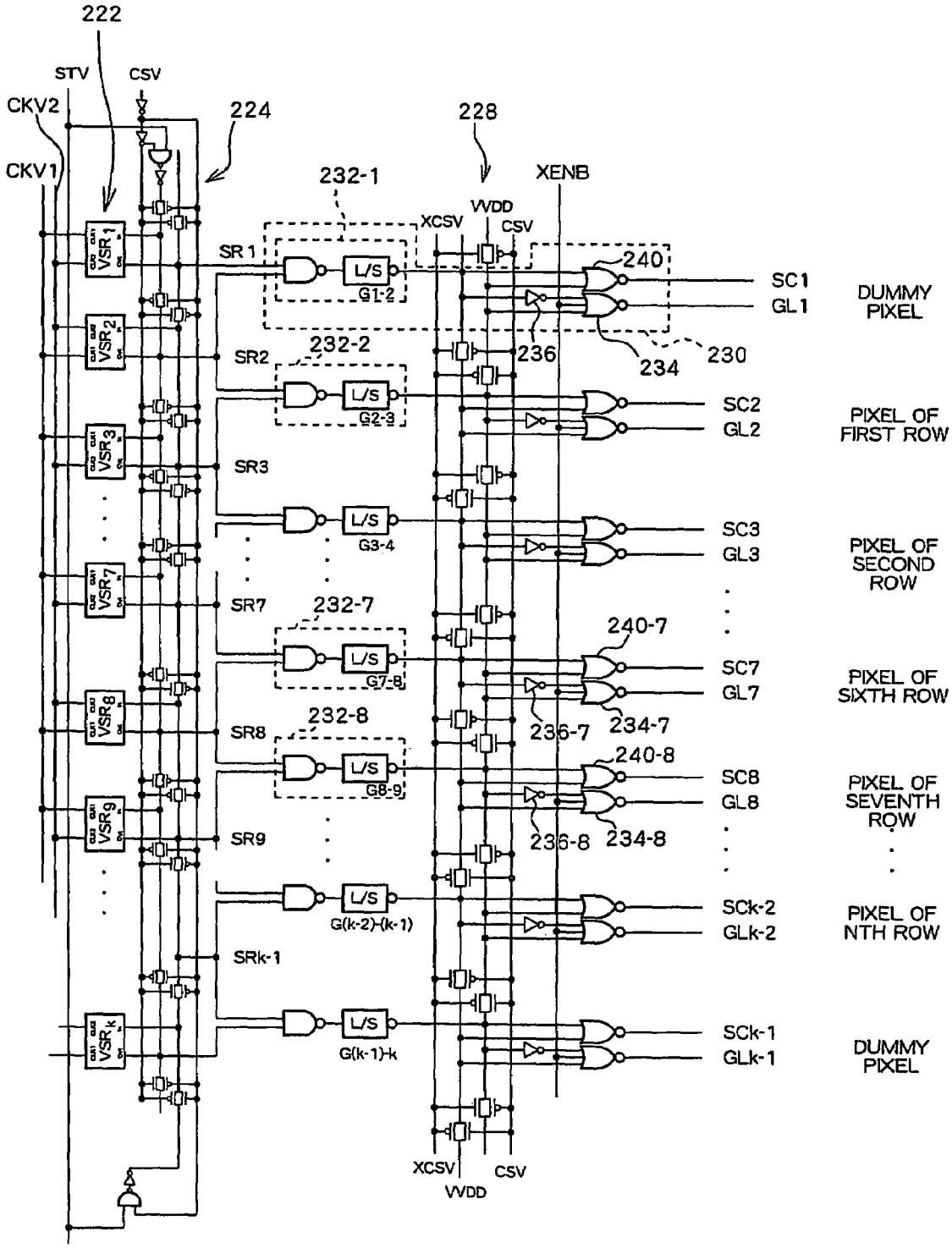
FIG. 3 is a diagram exemplifying a circuit structure of a V driver according to a first preferred embodiment of the present invention.

As shown in FIG. 3, the V driver 220 comprises a vertical transfer register 222 having k stages of registers, the number k being dependent on the number n of rows of the display portion 100 (k=n+2 in FIG. 3), a transfer control gate 224 which controls the data transfer direction of the register VSR, and a signal generator 230 (signal generation logic section) which generates the selection signal and the capacitor control signal. The signal generation logic section 230 comprises a logic section which generates capacitor control signals SC1-SCk to be output to the capacitor lines 12 based on a V start signal STV transferred by the register VSR and a logic section which generates selection signals GL1-GLk to be sequentially output to the selection lines 10. Similar to the control of the data transfer direction of the register VSR, a logic control gate 228 which switches between adjacent rows to be logically calculated within the signal generation logic section 230 is provided.

The registers $VSR_1$-$VSR_k$ sequentially transfer a V (vertical) start signal STV which instructs start of one vertical scan period to the adjacent (adjacent row) registers $VSR_1$-$VSR_k$ according to a vertical clock CKV having a frequency which is ½ of one horizontal scan period. The transfer control gate circuit 224 controls the transfer direction of the V start signal STV of the registers VSR1-VSRk according to a transfer direction control signal CSV. In the configuration of FIG. 3, when the signal CSV is at H level, all of the n-channel TFTs which receive an input of the signal CSV at the gates are switched on and all of the p-channel TFTs which receive an input of the signal CSV at the gates are switched off. Thus, the input and output to the registers are controlled in such a manner that the V start signal STV is supplied to the input terminal in of the register $VSR_1$, the output terminal out of the register VSR1 is connected to the input terminal in of the register VSR2, and the output terminal out of the register VSR2 is connected to an input terminal in of the register VSR3. Because of this, when the signal CSV is at the H level, as shown in the timing chart of FIG. 5, the data transfer direction of the vertical transfer register 222 sequentially proceeds through $VSR_1$, $VSR_2$, . . . $VSR_k$. When, on the other hand, the signal CSV is at the L level, the V start signal STV is supplied to the input terminal in of the register VSRk and data corresponding to the V start signal STV is transferred in the order of $VSR_k$, . . . $VSR_1$.

Figure 5:
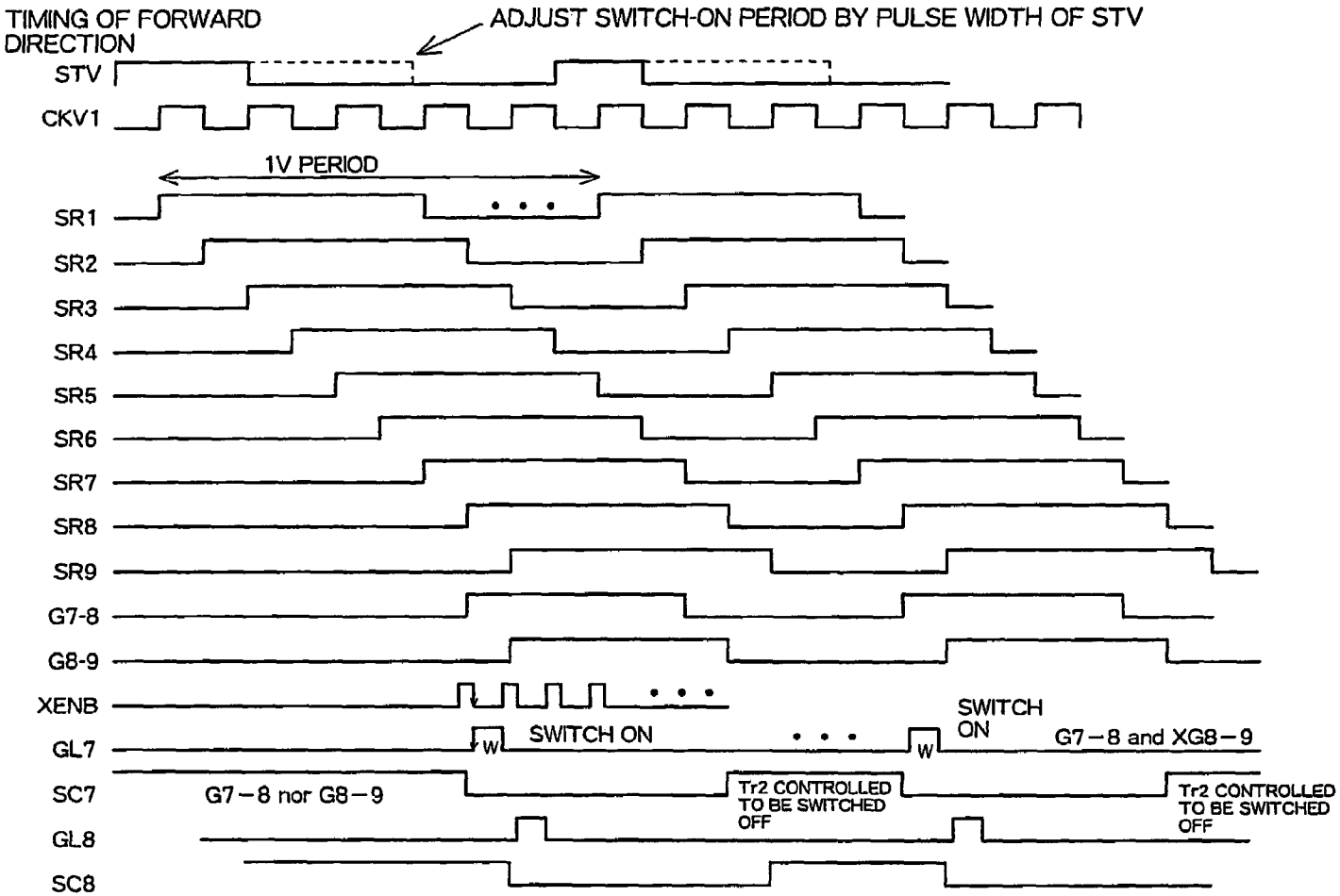
FIG. 5 is a timing chart showing an operation of the circuit structure of FIG. 3.

As shown in FIG. 5, the V start signal STV is set to an H level indicating a start at the beginning of one vertical scan (one frame) period, is maintained at the H level for a predetermined period within one frame, and is switched to and maintained at the L level for the rest of the frame period. The period of H level of the V start signal STV normally has a duration of approximately one horizontal scan period, but in the present embodiment this period is set at a longer period such as a period corresponding to 200 horizontal scan periods. A logic circuit is provided so that the duration of the H level period determines the duration of period in which the storage control signal output to the capacitor lines 12 is switched on. In FIG. 5, the duration of the H level period is shown to be approximately 4 horizontal scan periods for the purpose of simplifying the drawing. The duration of the H level period may be set at approximately 4 horizontal scan periods as shown in FIG. 5.

Operations of each constructing element will now be described with reference to a specific case in which the CSV signal is at the H level and data is transferred in the forward direction. The V start signal STV is latched by the first register $VSR_1$ at the rise of the vertical transfer clock CKV, and at the same time, the output $SR_1$ of the register $VSR_1$ is set to the H level. The H level period of the output $SR_1$ continues until the output $SR_1$ is changed to the L level at the timing of a first rise of the signal CKV after the V start signal supplied to the register $VSR_1$ is set to the L level. In other words, the H level period of the register output $SR_1$ has a duration which corresponds to the period in which the H level of the V start signal STV is maintained (pulse width).

The data latch timing of each register is deviated from all of the other registers by a half of the period of the vertical clock signal CKV. Therefore, as shown in FIG. 5, the second register $VSR_2$ latches the output $SR_1$ of the register $VSR_1$ at the timing of the next fall of the signal CSV (rise of the CSV inversion signal (CSV2)) and the output $SR_2$ is set to the H level accordingly. In this manner, each of the registers of the subsequent next rows $VSR_3$, $VSR_{k-1}$, and $VSR_k$ sequentially latches the output of the register of the previous stage and transfers the output. Therefore, the outputs $SR_1$-$SR_k$ of the registers $VSR_1$-$VSR_k$ have, as shown in FIG. 5, waveforms in which the H level is maintained for a period corresponding to the V start signal.

At the output side of the vertical transfer register 222, a logical multiplication (AND) circuit 232 of the signal generation logic section 230 is provided. The logical multiplication circuit 232 comprises a NAND circuit which applies a NAND operation to outputs $SR_{k-1}$ and $SR_k$ of registers of adjacent stages and a level shifter (L/S) with an inverting function which is provided at the output side of the NAND circuit.

Figure 4:
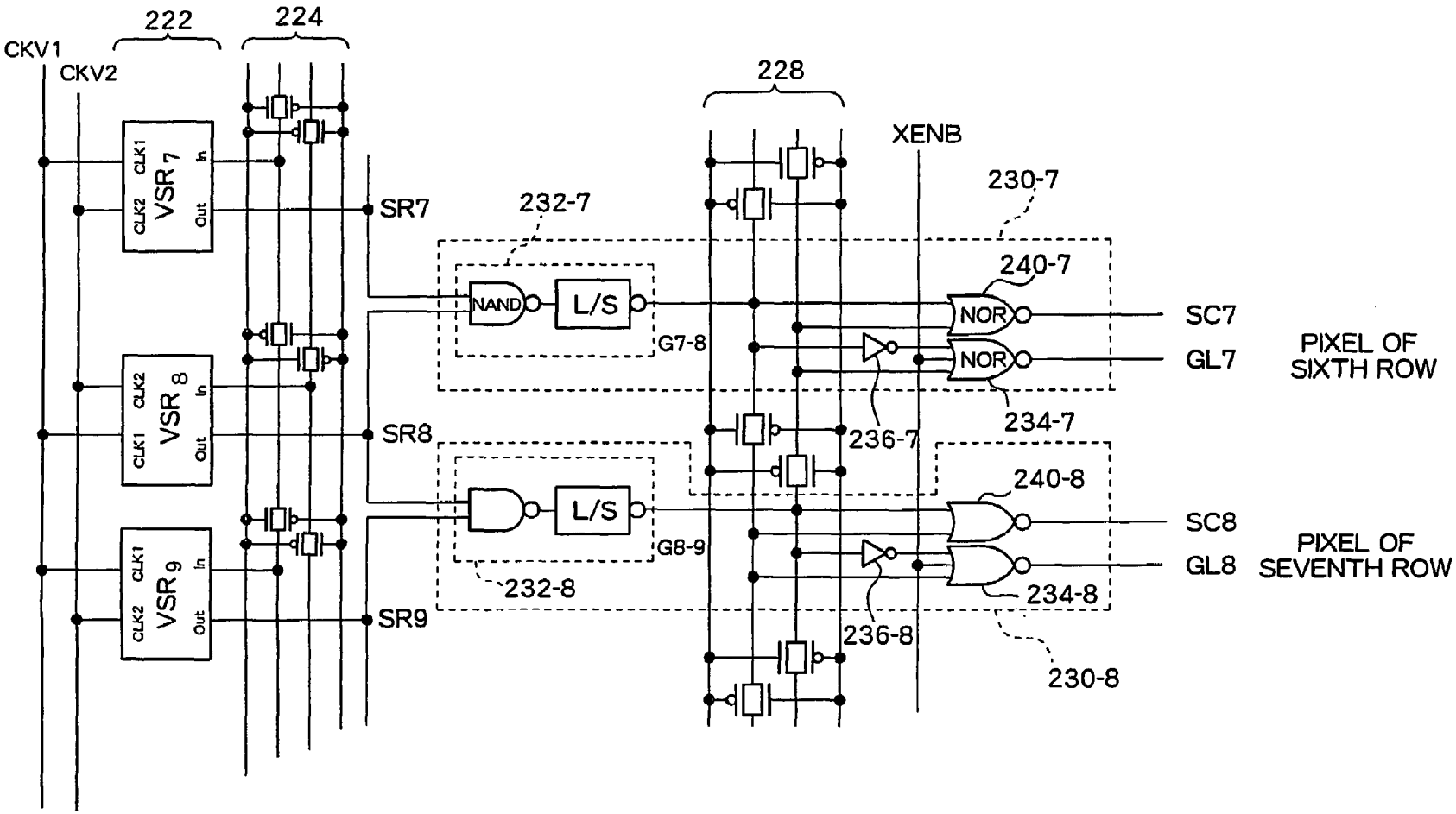
FIG. 4 is a diagram enlarging a portion of a structure shown in FIG. 3.

Referring to FIG. 4, which is an enlarged view of a structure which generates the selection signal GL7 and the capacitor control signal SC7 to be supplied to pixels of a sixth row from the outputs $SR_7$-$SR_9$ of the registers $VSR_7$-$VSR_9$ of the middle stages shown in FIG. 3, a generation process for the selection signal GL7 and the capacitor control signal SC7 based on the outputs of the registers of middle stages will be described. A NAND operation is applied to the outputs of the registers $VSR_7$ and $VSR_9$ in the NAND circuit of the corresponding logical multiplication circuit 232-7, the level of the NAND output is shifted and the H and L levels are inverted by the L/S with an inversion function, and the signal is output. The obtained inverted output is shown as "G7-8" in FIG. 5 and a logical multiplication signal (G7-8) is obtained at the logical multiplication circuit 232-7 according to a difference in the timings of the outputs of the registers $VSR_7$ and $VSR_8$. A NAND operation is applied to the outputs of the registers $VSR_8$ and $VSR_9$ by the NAND circuit of the corresponding logical multiplication circuit 232-8, the level of the NAND output is shifted and the level is inverted by the L/S with the inversion function, and the signal is output. The obtained inverted output is shown in FIG. 5 as "G8-9" and a logical multiplication signal (G8-9) is obtained according to a difference in timings of outputs of the registers $VSR_8$ and $VSR_9$.

The level shifter L/S with inversion function is provided so that the level of the selection signal output to the selection line 10 via a NOR circuit at the later stage becomes a level sufficient for reliably switching the selection transistor Tr1 of the corresponding row on and off. More specifically, the level shifter shifts and inverts the level so that the H level becomes −2V and the L level becomes 10V when the L level of the output of the NAND circuit of the logical multiplication circuit 232 is 0V and the H level of the output of the NAND circuit is 10V. In this manner, logical multiplication signals are output form the logical multiplication circuits 232-7 and 232-8 at the timings shown by G7-8 and G8-9 of FIG. 5.

The logical multiplication signals G7-8 and G8-9 are supplied to NOR circuits 234 and 240, respectively, via the logic control gate 228. Because the CSV signal is at the H level, the logic control gate 228 is controlled to be switched to allow supply of the output G7-8 from the logical multiplication circuit 232-7 and the output G8-9 from the logical multiplication circuit 232-8 to the NOR circuits 234-7 and 240-7 for the pixel of the sixth row, respectively.

An inverted signal of the logical multiplication output G7-8 inverted by an inverter 236-7, an eighth logical multiplication output G8-9, and an enable signal ENB for prohibiting output of the selection signal at the switching timing of one horizontal scan (1H) period (in the circuit structure of the present embodiment, an inverted enable signal XENB as shown in FIG. 5) are supplied to the NOR circuit 234-7 for selection signal which outputs the selection signal GL7 to the pixels of the sixth row.

Therefore, a NOR calculation signal which is set to the H level (10V) only when all three input signals are at the L level is output from the seventh NOR circuit 234-7. Here, the inverted signal of the output G7-8 of the seventh logical multiplication circuit 232-7 and the output G8-9 of the eighth logical multiplication circuit 232-8 are simultaneously at the L level in FIG. 5 for a duration of a half period (1H period) of the signal CKV from the time when the output G7-8 is set to the H level until the output G8-9 is next set to the H level, and the period of the 1H of the XENB signal other than the first and last period. Therefore, the selection signal GL7 of H level is output from the NOR circuit 234-7 as shown in FIG. 5 as GL7 from the timing when the XENB signal is set to the L level to the rise to the H level. The XENB signal and the ENB signal are supplied with an amplitude of, for example, 0V and 3V from the external driver IC and is shifted by, for example, the level shifter L/S to a signal of an amplitude of −2V and 10V before the signal is supplied to the NOR circuit 234.

The seventh NOR circuit 240-7 which outputs a capacitor control signal outputs a capacitor control signal SC7 which is set to the H level during a period when both the output G7-8 of the logical multiplication circuit 232-7 and the output G8-9 of the logical multiplication circuit 232-8 are at the L level, and is set to the L level during a period when at least one of the outputs G7-8 and G8-9 is at the H level. As described above, such a capacitor control signal SC is supplied to the second electrode of the storage capacitor Cs of the pixel of the corresponding row, and when the capacitor control signal SC is set to the H level, the gate potential of the element driving transistor Tr2 which is a p-channel type transistor is increased and the element driving transistor Tr2 is controlled to be switched off. The capacitor control signal SC has the period of the L level (first voltage level Vsc1) which is equal to the sum of the H level period of the output from the logical multiplication circuit 232 and one horizontal scan period (period of difference between reading of adjacent rows). The remaining period within one vertical scan period is the period of the H level (second voltage level Vsc2), that is, a period of off-control of the element driving transistor Tr2 (period in which the EL element is extinguished). In other words, the non-emitting period of the EL element of each row corresponds to the H level period of the V start signal STV, and thus the non-emitting period can be adjusted by adjusting the H level period (pulse width) of the signal STV.

As shown in FIG. 5, the selection signal GL8 for the pixels of the next row is set to the H level during the horizontal scan period following the period in which the GL7 is set to the H level, and the capacitor control signal SC8 for the next row during this period is at the L level. More specifically, the capacitor control signal SC8 is set to the L level when the logical multiplication output G8-9 is set to the H level and continues to be at the L level until the logical multiplication output G9-10 is set to the L level. The capacitor control signal SC8 is set to the H level when the logical multiplication output G9-10 is set to the L level to switch the EL elements of the pixels in the seventh row off. In this manner, control signals that differ from each other by a horizontal scan period and that is set to the H level to extinguish the EL elements for the same period are output to the capacitor lines 12 of each row. The extinguish period (period of increased voltage of the capacitor control signal) can be varied by the V start signal STV as described above and can be set, for example, at approximately 2 ms or may be further extended within a range that does not cause flicker in the light emission of the EL element. That is, the length can be extended to approximately 4 ms which is the longest time in which the extinguished element is recognized as a flicker by the human eye within one vertical scan period (one frame) which is 16 ms. When the control signal is to be controlled by the external IC to be at the extinguishing level for all capacitor lines 12 during a vertical return period, the period that can be secured as the extinguishing period is approximately 900 μs. By generating the capacitor control signal to be output to the capacitor line 12 using a built-in driver, it is possible to control the element driving transistor Tr2 and the EL element to be switched off in each pixel for each row, and thus the off-control period can be set for a long period of time and the persistent image can be reliably resolved.

As described above, with a structure of the V driver as shown in FIG. 3, the selection signal is obtained by a logic calculation of the form:

$$GLs=Gs-(s+1)\text{AND}\ XG(s+1)-(s+2)$$

In this equation, the term s represents a number of rows of pixels and is in the range of 1-n and the term XG represents an inverted signal of a corresponding G signal.

The capacitor control signal can be obtained by a logic calculation of the form:

$$SCs=Gs-(s+1)NOR\ G(s+1)-(s+2)$$

In the circuit structure of FIG. 3, voltages such as PVDD=8V, GND=0V, VVDD=10V, VVBB=−2V, CV=−2V, etc. can be prepared to set both the capacitor control signal SC and the selection signal GL to be output to the capacitor line 12 and the gate line 10 to have the H level of VVDD and the L level of VVBB. By employing such a voltage relationship, switching on and off of the selection transistor Tr1 of each pixel, switching on and off of the element driving transistor Tr2, and the turning on and off of the EL element can be reliably and accurately controlled.

In FIG. 3, k stages of registers are provided, the number k being equal to the number of rows of pixels n plus 2 (k=n+2). Selection signals GL1 and GLk−1 and capacitor control signals SC1 and SCk−1 are output to dummy pixels in a row before the pixels of the first row and dummy pixels in a row next to the pixels of the nth row. These dummy pixels do not need to be actually formed on the panel. The k stages of registers are provided because an sth output (output for pixel of (s−1)th row) is generated in the circuit structure of FIG. 3 using three stages of registers from (s−1) to (s+1) as described above.

Second Preferred Embodiment

Next, a structure which is simpler than that in the first preferred embodiment, and an operation of this structure for generating the selection signal GL and the capacitor control signal SC similar to those in the first preferred embodiment based on outputs from the registers in the vertical transfer register 222, will be explained referring to FIGS. 2, 6, and 7.

This structure is identical to the structure of FIG. 3 up to the point where the order of input/output to the registers VSR of the vertical transfer register 222 is controlled by the transfer control gate 224. The structure of this embodiment differs from the structure of FIG. 3 in that the logic control gate 228 and the logical multiplication circuit 232 of FIG. 3 are omitted, the generator of the capacitor control signal to be output to the capacitor line 12 is simplified to a structure with an inverter 250 only, and the structure (logic) of the selection signal generator is different. In addition, although in the structure of FIG. 3, dummy pixels are provided at the uppermost row and at the lowermost row of the panel, and selection signal GL and the capacitor control signal SC are generated and output to these rows also, in the structure of FIG. 6, two rows of dummy pixels are provided at the uppermost rows and at the lowermost rows. Because of this structure, dummy registers $VSR_{d1}$ and $VSRd_2$ are provided in front of the register $VSR_1$ for the pixels of the first row.

A circuit structure of FIG. 6 and operation of the circuit structure will now be described. When the transfer direction control signal CSV is at the H level, the V start signal STV is supplied to an input terminal in of the first dummy register $VSR_{d1}$ and the register $VSR_{d1}$ reads the V start signal STV at the rise of the vertical clock CKV1 and outputs from an output terminal out. An output $SR_{d1}$ from the register $VSR_{d1}$ is input to the second dummy register $VSR_{d2}$ and the register $VSR_{d2}$ reads the output $SR_{d1}$ at the timing of the next fall of the signal CKV1 (timing of rise of CKV2) and outputs an output $SR_{d2}$ from an output terminal out. The output $SR_{d2}$ of the register $VSR_{d2}$ is supplied to an input terminal in of the register VSR1 and the register $VSR_1$ reads the output $SR_{d2}$ at the timing of the next rise of the signal CKV1 and outputs an output $SR_1$ from an output terminal out. The registers $VSR_1$-$VSR_n$ are registers which output selection signals GL1-GLn and capacitor control signals SC1-SCn to the actual pixels. Registers $VSR_{d3}$ and $VSR_{d4}$ corresponding to the dummy pixels are provided downstream of the register $VSR_n$ and these registers sequentially read the output of the register of the previous stage according to the rise or fall of the signal CKV1 and sequentially output to the register of the next stage.

An inverter 250 is provided as the capacitor control signal generator between the register $VSR_n$ of the nth row and the capacitor line 12. The inverter 250 inverts the input to the register $VSR_n$ (output of register $VSR_{n-1}$) and outputs the resulting signal to the capacitor line 12 as the capacitor control signal SCn of pixels of nth row. A voltage GND as an L level power supply and a voltage VVDD as an H level power supply are supplied to the inverter 250. Therefore, the L level of the capacitor control signal SC output from the inverter 250 (first voltage level Vsc1) is 0V which is equal to GND and the H level (second voltage level Vsc2) is equal to the voltage VVDD which is, for example, 10V.

A selection signal logic circuit 260 is provided as the selection signal generator between the register $VSR_n$ and the selection line 10*n*. The logic circuit 260 comprises a NOR circuit 262 and inverters 264 and 266. The NOR circuit 262 calculates NOR of the output SRn of the register $VSR_n$, an inverted signal of an input signal to the register $VSR_n$ ($XSR_{n-1}$, that is, capacitor control signal $SC_n$), and an inverted signal XENB of the enable signal. The inverter 264 inverts the output of the NOR circuit 262 and the inverter 266 further inverts the output of the inverter 264 and supplies the resulting signal to the selection line 10 of the pixel of the nth row. In this manner, the NOR circuit 262 and the inverters 264 and 266 as a whole form a NOR gate which calculates NOR of the output SRn−1 and the output SRn and outputs a result of the NOR calculation to the selection line of the nth row as the selection signal GLn. As the inverter 264, the level shifter with an inversion function provided at the output side of the logical multiplication circuit 232 in FIG. 3 may be used so that the polarity of the output is inverted, the voltage level of the signal is shifted to a necessary voltage level, and the output of the level shifter is output to the inverter 266.

The input of the register $VSR_1$ of the first row is the output SRd2 of the dummy register $VSR_{d2}$ which is a previous register of the register $VSR_1$. This output SRd2 is inverted by the inverter 250 and the inverted signal is output to the capacitor line 12 as the capacitor control signal SC1 of the pixel of the first row. The selection signal logic circuit 260 of the first row outputs a result of a NOR calculation between the inverted signal XSRd2 of the output SRd2 of the register $VSR_{d2}$ and the output SR1 of the register $VSR_1$ to the selection line 10 of the first row as the selection signal GL1.

Figure 6:
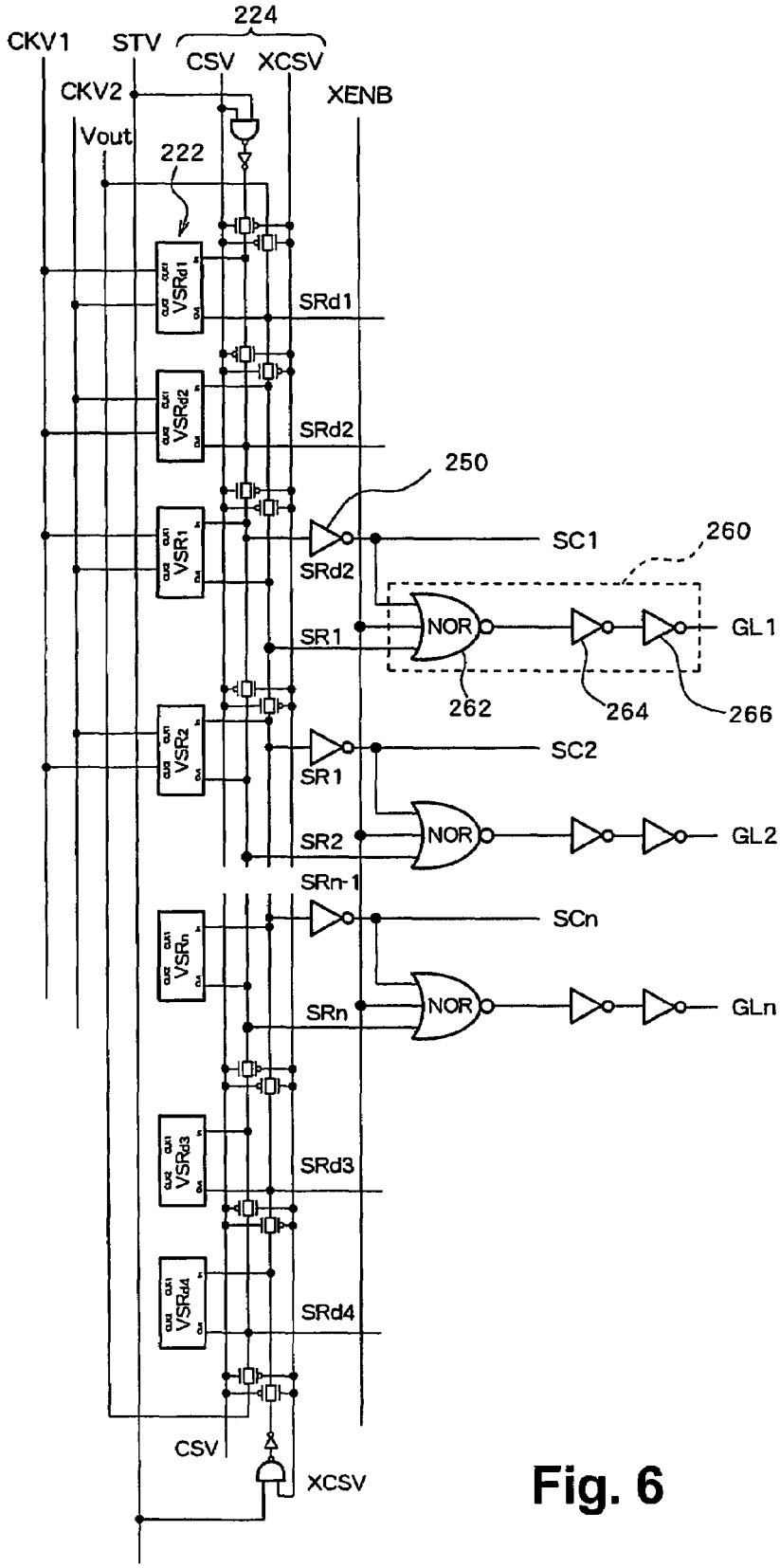
FIG. 6 is a diagram exemplifying a circuit structure of a V driver according to a second preferred embodiment of the present invention.
Figure 7:
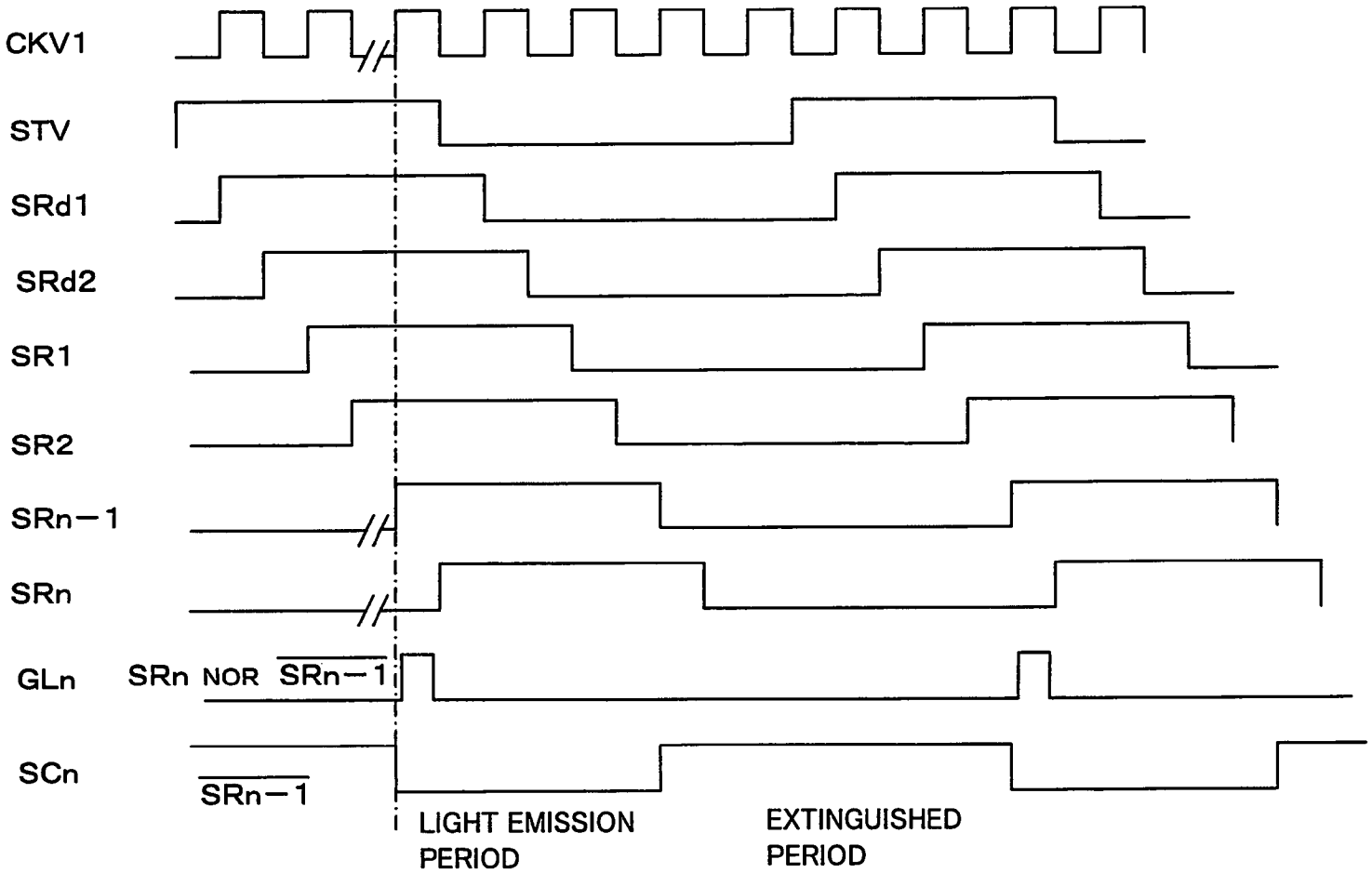
FIG. 7 is a timing chart showing an operation of a circuit structure of FIG. 6.

As described, with the circuit structure of the V driver as shown in FIG. 6 also, the period corresponding to the L level period of the V start signal STV becomes the H level period of the capacitor control signal SCn, that is, the extinguishing period of the EL element in the pixel of the corresponding row. Therefore, with the circuit structure of the second preferred embodiment also, the EL element can be extinguished and the element driving transistor Tr2 can be controlled to be switched off for each row by adjusting the V start signal STV. As described above, it is possible to omit the transfer gate and logic circuit compared to the circuit structure of FIG. 3, and thus the V driver 220 can be formed with a minimum number of circuit elements and the area of the V driver can be reduced. In a small display device which has severe demands for reduction of the circuit area on a panel such as, for example, an electric viewfinder (EVF) or the like, the area of the circuit elements to be built into the panel must be reduced. Therefore, the structure as described in the second preferred embodiment is advantageous for the display device such as EVF or the like. In addition, the power consumption can be reduced with this structure.

Figure 8:
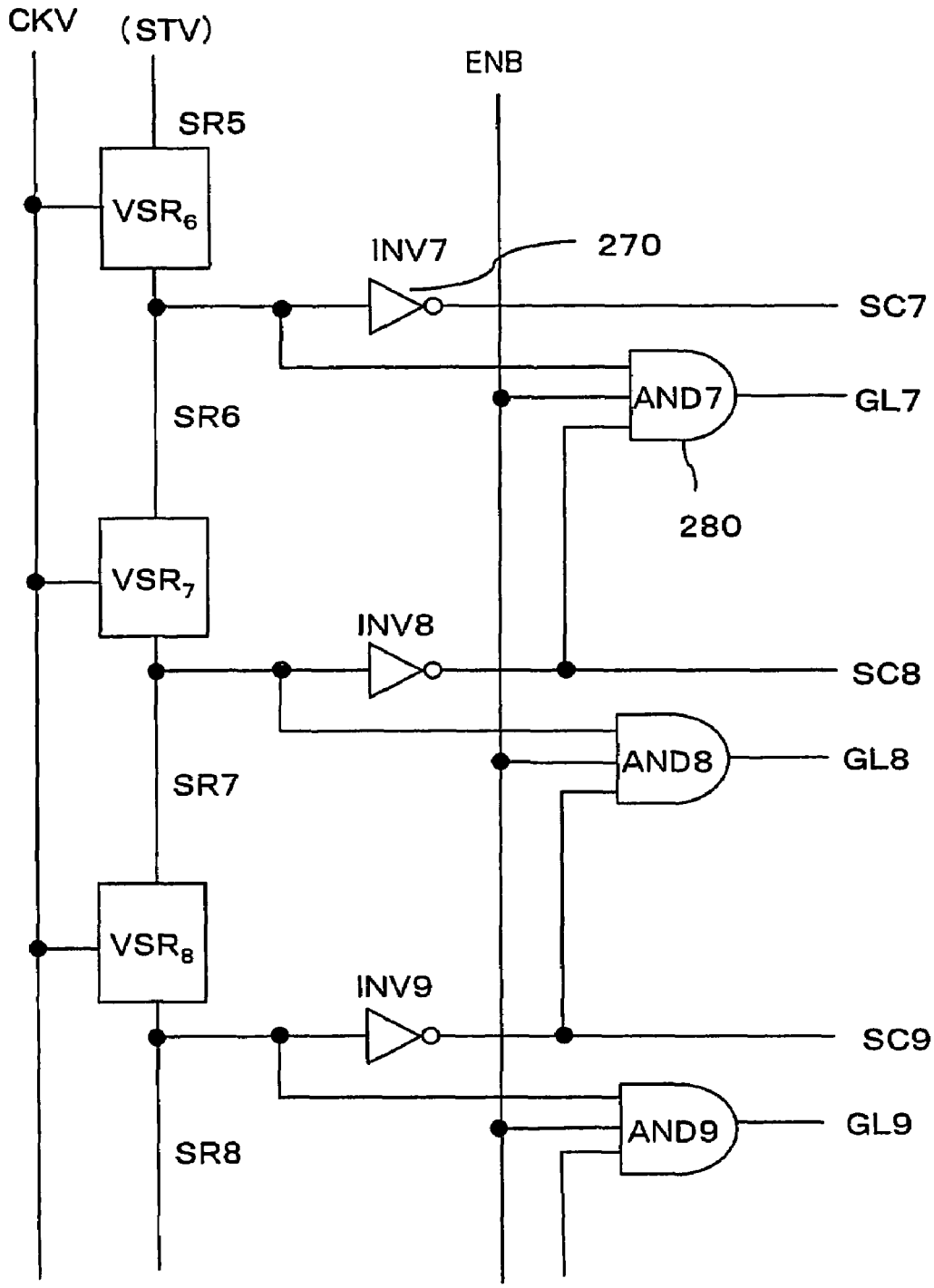
FIG. 8 is a diagram for explaining the structure of a logic circuit in which the circuit structure of FIG. 6 is generalized.
Figure 9:
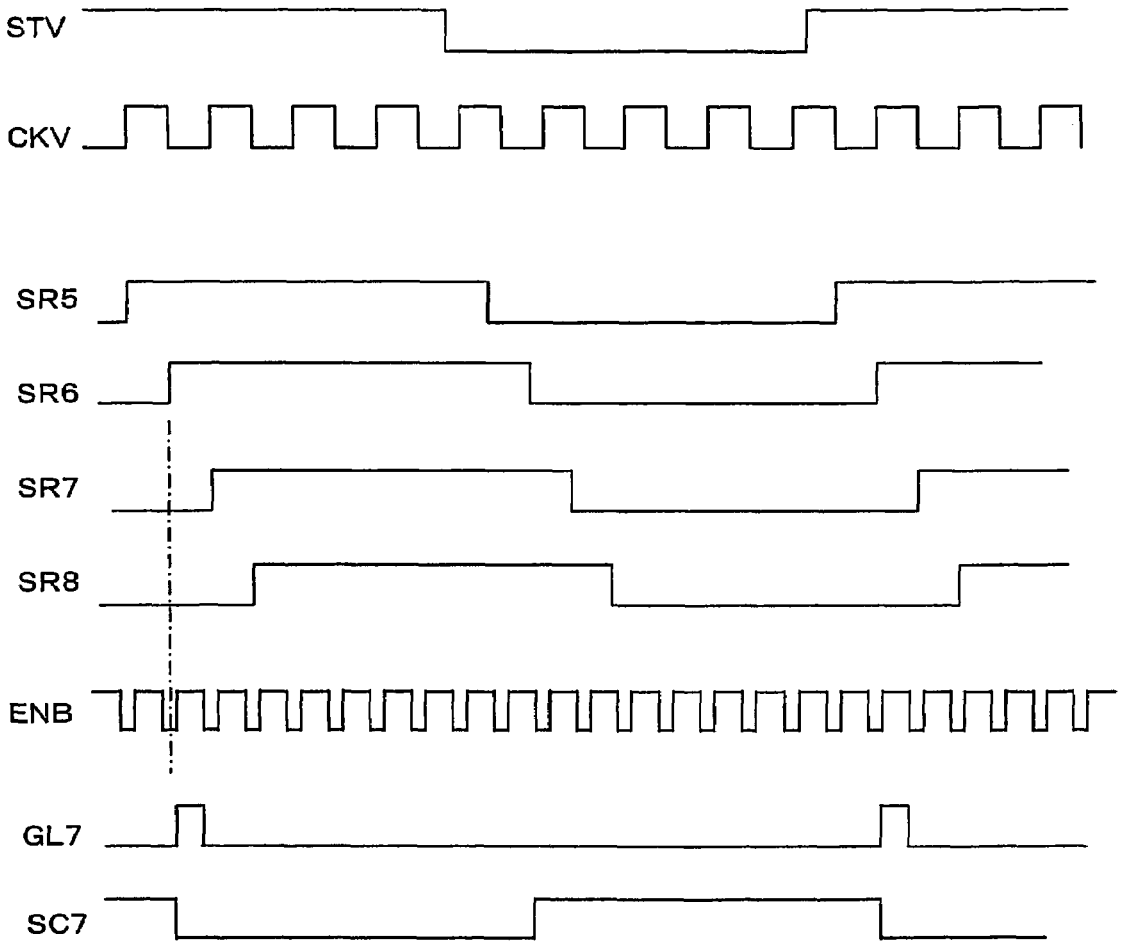
FIG. 9 is a timing chart showing an operation of the circuit structure of FIG. 8.

FIG. 8 shows a logic circuit structure in which the circuit structure specifically explained with reference to FIG. 6 is further generalized. More specifically, FIG. 8 shows another logic circuit structure which generates the selection signal to be output to the selection line 10 and the capacitor control signal to be output to the capacitor line 12 from the stages of registers of the vertical transfer register 222. FIG. 9 is a timing chart of the structure of FIG. 8. In the circuit structure of FIG. 8 also, a gate similar to the transfer control gate 224 of FIG. 3 is present, but is not shown in FIG. 8, as FIG. 8 exemplifies a configuration in which the transfer direction control signal CSV is at the H level and the data (V start signal STV) is transferred from the register $VSR_{n-1}$ toward the register $VSR_n$.

FIG. 8 shows registers $VSR_6$-$VSR_8$ and a signal generator which generates the selection signals GL7-GL9 and capacitor control signals SC7-SC9 using the outputs of the registers $VSR_6$-$VSR_8$ as an intermediate stage of the V driver. The start signal STV is sequentially transferred to later registers according to the vertical clock CKV. Then, when the output SR5 of the previous register $VSR_5$ is input to the register $VSR_6$, the register $VSR_6$ reads the output SR5 according to the signal CKV and outputs a signal SR6. The output SR6 is supplied to the logical multiplication circuit 280 for the selection line of the seventh row and also to an inverter 270. The inverter 270 inverts the H and L levels of the output SR6, shifts the level of the output SR6 so that, for example, the H level is 10V and the L level is −2V, and outputs the resulting signal to the capacitor line of the pixel of the seventh row as the capacitor control signal SC7.

As described above, the selection signal generation circuit (logical multiplication circuit for selection signal) 280 of the seventh row calculates a logical product of the output SR6 of the register $VSR_6$, the inverted output XSR7 of the output SR7 of the shift register $VSR_7$ of the next stage, and the enable signal ENB. Therefore, a selection signal GL7, which is set to the H level when the output SR6 and the inverted output XSR7 are both at the H level and the enable signal ENB rises to allow the selection signal to the selection line, is output to the selection line for the pixels of the seventh row. In order to ensure that the level of the selection signal GL output from the logical multiplication circuit 280 can sufficiently drive the selection transistor of each pixel, a level shifter must be provided in a path from the register $VSR_n$ to the corresponding logical multiplication circuit 280 or with in the circuit 280 to shift the H level and the L level of the register outputs SRn to 10V and −2V, respectively.

As described, with a structure of a logic circuit of FIG. 8, a capacitor control signal SCn which is set to the H level for a period corresponding to the H level period of the V start signal STV can be output to the capacitor line of each row, similar to the specific circuit structure shown in FIG. 6. In addition, it is possible to output the selection signal to each selection line 10 every horizontal scan period and write a data signal corresponding to the display content to the corresponding pixel, and at the same time, output the capacitor control signal SC to the capacitor line 12 as described above, and execute the control to extinguish the EL element and to switch the element driving transistor Tr2 off.

What is claimed is:

1. A display device having a plurality of pixels arranged in a matrix and a vertical driver which sequentially drives the plurality of pixels, wherein each of the plurality of pixel comprises:

an element to be driven;

a selection transistor which reads a data signal from a data line extending along a vertical scan direction according to a selection signal output on a selection line extending along a horizontal scan direction;

a storage capacitor having a first electrode and a second electrode and which stores, as a voltage with respect to a voltage supplied from a capacitor line to the second electrode, a data signal from the selection transistor supplied to the first electrode; and an element driving transistor having a gate connected to the first electrode of the storage capacitor and which supplies power corresponding to a data voltage stored in the storage capacitor from a power supply to the element to be driven, a plurality of the selection lines are provided, each of which extends along the horizontal scan direction, the vertical driver comprises a vertical transfer register having a plurality of stages of registers which sequentially read and transfer a vertical start signal indicating a start timing of one vertical scan period, a selection signal generator which generates the selection signal to be supplied to the selection line, and a capacitor control signal generator which generates a capacitor control signal to be supplied to the capacitor line, the selection signal generator generates, based on the vertical start signal, the selection signals at timings which differ from each other by one horizontal scan period to be sequentially supplied to the selection lines, the capacitor control signal generator generates the capacitor control signal based on an output, corresponding to the vertical start signal, from the register of each stage of the vertical transfer register, and the capacitor control signal has a first voltage level state which causes the storage capacitor to store the voltage corresponding to the data signal via the capacitor line and causes the element driving transistor to operate according to the stored voltage and a second voltage level state which causes a corresponding element driving transistor to be controlled to be switched off.

2. A display device according to claim 1, wherein the capacitor line is provided for each row and extends along the horizontal scan direction, and the capacitor control signals are sequentially output from the vertical driver to the capacitor lines at timings that differ from each other by one horizontal scan period.

3. A display device according to claim 1, wherein the vertical transfer register of the vertical driver transfers the vertical start signal to the register of a next stage every horizontal period according to a vertical transfer clock signal, and the selection signal generator and the capacitor control signal generator generate the selection signal to be supplied to the corresponding selection line and the capacitor control signal to be supplied to the capacitor line based on a difference in timings of outputs from the stages of the vertical transfer register.

4. A display device according to claim 1, wherein the vertical driver determines a duration of the second voltage level, which controls the element driving transistor to be switched off, of the capacitor control signal based on a duration of a start instruction level of the vertical start signal.

5. A display device according to claim 1, wherein at least the vertical transfer register, the selection signal generator, and the capacitor control signal generator of the vertical driver are formed at a peripheral position of a display portion on a substrate on which the plurality of pixels are formed.

6. A display device according to claim 1, wherein the selection signal generator and the capacitor control signal generator comprise logic calculation units which perform logic calculations using a difference between an output from a register of a corresponding stage of the vertical transfer register and an output from a register of an adjacent stage and generate the selection signal and the capacitor control signal.

7. A display device according to claim 1, wherein the capacitor control signal generator generates the capacitor control signal by inverting an output from the register of a corresponding stage of the vertical transfer register, and the selection signal generator generates the selection signal based on an output from the register of the corresponding stage of the vertical transfer register and an inverted signal of an output from a register of an adjacent stage.

8. A display device according to claim 1, wherein the element to be driven is a current-driven light emitting element.

9. A display device according to claim 1, wherein the element to be driven is an organic electroluminescence element.

10. A method of driving a display device comprising a plurality of pixels arranged in a matrix of n rows and m columns, wherein a selection line and a capacitor line are formed for each row along a horizontal scan direction, a data line is formed for each column along a vertical scan direction, each of the plurality of pixels comprises an element to be driven, a selection transistor having a gate connected to the selection line and a first conductive region connected to the data line and which reads a data signal from the data line according to a selection signal output to the selection line, an element driving transistor having a gate connected to a second conductive region of the selection transistor and which controls power to be supplied from a power supply to the element to be driven, and a storage capacitor having a first electrode and a second electrode, wherein the first electrode is connected to the second conductive region of the selection transistor and the gate of the element driving transistor, the second electrode is connected to the capacitor line, and a data signal supplied via the selection transistor to the first electrode is stored in the storage capacitor as a potential difference with respect to a capacitor control signal supplied from the capacitor line to the second electrode, the capacitor control signal being based on an output, corresponding to the vertical start signal, from a vertical transfer register, and wherein a selection signal is output to the selection line of an nth row to control the selection transistors of pixels of the nth row to be switched on and write a voltage corresponding to a data signal to the storage capacitor, and a potential of the capacitor control signal to be output to the capacitor line of the nth row is set to a first voltage level which causes the element driving transistor to be switched on and operate according to a data signal supplied via the selection transistor, and after the first voltage level is maintained for a period corresponding to a duration of a start instruction level of a vertical start signal indicating a start timing of one vertical scan period, the potential of the capacitor control signal is changed to a second voltage level which controls, via the capacitor line, the element driving transistor to be switched off for a period in which the selection line of the nth row is not selected and until a start of a next vertical scan period so that the element driving transistor and the element to be driven are controlled to be switched off.

11. A method of driving a display device according to claim 10, wherein the element to be driven is a current-driven light emitting element, and the element to be driven emits light according to power supplied via the element driving transistor and is extinguished by the element driving transistor being controlled to be switched off.

12. A method of driving a display device according to claim 10, wherein the element to be driven is an organic electroluminescence element, and the element to be driven emits light when power is supplied via the element driving transistor and is extinguished by the element driving transistor being controlled to be switched off.

* * * * *